US006257545B1

(12) United States Patent
Tokita et al.

(10) Patent No.: US 6,257,545 B1
(45) Date of Patent: Jul. 10, 2001

(54) MECHANISM FOR TENTATIVELY FIXING DECORATIVE SHEET

(75) Inventors: Shuji Tokita; Fumiski Yamada, both of Nagano-ken (JP)

(73) Assignee: Soyu Co., Ltd., Nagano-ken (JP)

( * ) Notice: Subject to any disclaimer, the term of this patent is extended or adjusted under 35 U.S.C. 154(b) by 0 days.

(21) Appl. No.: 09/331,400

(22) PCT Filed: Mar. 25, 1998

(86) PCT No.: PCT/JP98/01352

§ 371 Date: Aug. 23, 1999

§ 102(e) Date: Aug. 23, 1999

(87) PCT Pub. No.: WO99/20854

PCT Pub. Date: Apr. 29, 1999

(30) Foreign Application Priority Data

Oct. 22, 1997 (JP) ..... 9-289292

(51) Int. Cl.[7] ..... E04G 9/10

(52) U.S. Cl. ..... 249/15; 249/16; 249/91

(58) Field of Search ..... 249/15, 16, 219.1, 249/83, 85, 96, 97, 91; 52/315, 509; 264/35, 277

(56) References Cited

U.S. PATENT DOCUMENTS

| | | | | |
|---|---|---|---|---|
| 2,080,190 | * | 5/1937 | Sinner | 52/509 |
| 5,009,387 | * | 4/1991 | Scott et al. | 249/15 |

FOREIGN PATENT DOCUMENTS

| | | | | |
|---|---|---|---|---|
| 1016480 | * | 11/1952 | (FR) | 52/385 |
| 54-80627 | | 6/1979 | (JP) . | |
| 55-6391 | | 1/1980 | (JP) . | |
| 62-303 | | 1/1987 | (JP) . | |
| 3-40183 | | 6/1991 | (JP) . | |

* cited by examiner

*Primary Examiner*—Michael Safavi
(74) *Attorney, Agent, or Firm*—Burns, Doane, Swecker & Mathis, L.L.P.

(57) ABSTRACT

A tentative fixing means (4) used for tentatively fixing a stone material (2) to a surface (31) of a concrete form panel (3) before concrete is poured into a form is provided with a bolt (5), a nut (6) and a decorative plate holding member (7). When the nut (6) is screwed on the bolt (5), the stone material (2) is pressed against and fixed to the surface (31) of the form panel by the decorative plate holding member (7). The arm portions (73(1)–73(4)) of the decorative plate holding member (7) are elastically deformable at the decorative plate holding surface (74) of their outer end sections in the nut-screwing direction. Therefore, even when the thickness of the stone materials are different, the stone materials can be pressed against and tentatively fixed to the surface of the form panel reliably by the decorative plate holding member (7).

8 Claims, 9 Drawing Sheets

(a)

(b)

(a)

(b)

(a)

(b)

(c)

MECHANISM FOR TENTATIVELY FIXING DECORATIVE SHEET

TECHNICAL FIELD

This invention relates to a mechanism for tentatively fixing decorative plates on a surface of a form for forming a concrete product in a method of adhering decorative plates such as wall stones, tiles and the like on the surface of the concrete product.

In particular, this invention pertains to a mechanism for tentatively fixing decorative plates which is suitable to use in a process for tentatively fixing decorative plates on a surface of a form in a method wherein form panels are used to constitute a form for a concrete product, decorative plates are tentatively fixed at least partially on surfaces of the form panels, concrete is filled inside the form, the tentative fixing of the decorative plates is released after the concrete is hardened, and the form panels are removed to obtain the concrete product having the decorative plates embedded therein.

BACKGROUND ART

Concrete retaining walls, building walls and other walls are sometimes covered with wall stones, tiles and other decorative plates for decoration and other purposes. As a typical method of placing decorative plates, it is known one in which decorative plates are tentatively fixed on a surface of a form for molding a concrete product, and concrete is poured into the form with this condition, whereby placing of the decorative plates are carried out at the same time when the concrete is hardened.

As a mechanism for tentatively fixing decorative plates on a form in the above method, there is known one that uses bolt and nut to tentatively fix the decorative plates on the surface of a form, wherein the bolt is removed after the concrete is hardened, and the nut is left as it is embedded in the concrete. For example, JP-A 62-59760 discloses such a mechanism for tentatively fixing a decorative plate.

The conventional mechanism for tentatively fixing a decorative plate, however, has problems as follows.

First, such decorative plates as a stone material and the like have sometimes a front surface which is a finished flat one, but have a back surface left uneven as it is when quarried. No problem may occur when bolt and nut or other tentative fixing means is used to tentatively fix a decorative plate one by one on a form panel. However, when a single tentative fixing means is used to tentatively fix four decorative plates on a form panel at one time as disclosed in the above-mentioned patent publication for the purpose that tentative fixing operation is carried out in a short time, there is a possibility that the four decorative plates are not properly fixed on the form panel because each decorative plates has a different thickness. If tentative fixing of the decorative plate on the form panel is not carried out securely, the decorative plate may fall off the form panel due to forces and vibration applied to the decorative plate when concrete is poured.

Second, when a bolt constituting the tentative fixing mechanism is removed after concrete is hardened, since the thread portion of the bolt is embedded in the concrete, the bolt cannot easily be removed, which is a problem.

Third, a decorative plate must be placed appropriately at a predetermined position when it is tentatively fixed on a form panel. If the decorative plate cannot be positioned effectively and easily, efficiency of its placing operation is degraged, which is not appropriate.

DISCLOSURE OF INVENTION

An object of this invention is to provide a decorative-plate tentative fixing mechanism which is able to ensure tentative fixing of a stone material and other decorative plates having a different thickness on a form panel.

An object of this invention is also to provide a decorative-plate tentative fixing mechanism in which tentative fixing of a decorative plate can easily be released after concrete is hardened.

Further, an object of this invention is to provide a decorative-plate tentative fixing mechanism in which positioning of each decorative plate can be carried out effectively when it is tentatively fixed on a form panel.

In order to achieve the above objects, according to this invention, a decorative-plate tentative fixing mechanism is constituted as follows. This mechanism is suitable for use in a process of tentatively fixing a decorative plate on a surface of a form panel, and the process is included in a method wherein form panels are used to constitute a form for molding a concrete product, decorative plates are tentatively fixed at least one part of surfaces of the form panels, concrete is filled inside the form, the tentative fixing of the decorative plates is released after the concrete is hardened, whereby producing a concrete product whose surface has the decorative plates embedded therein.

Namely, the decorative-plate tentative fixing mechanism of this invention comprises a tentative fixing means for pressing each decorative plate against the surface of the form plate to tentatively fix it thereon and a hole for attaching the tentative fixing means formed in the form panel. The tentative fixing means has a bolt, a nut, and a decorative plate holding member, wherein the bolt has a head portion and a leg portion formed with an external thread, and is inserted into the hole for attaching the tentative fixing means from a rear surface of the form plate, while a nut is screwed on a part of the bolt leg portion projected from the form plate, to thereby press the decorative plate against the surface of the form plate via the decorative plate holding member.

Further, the decorative-plate holding member is formed with a decorative-plate holding surface for holding the rear surface of the decorative plate, and the decorative-plate hiding surface is elastically deformable in a nut-screwing direction.

Furthermore, after concrete is hardened, only the bolt is removed, whereas the nut and the decorative plate holding member are left embedded in the concrete product.

Here, the decorative plate holding member may be constituted so that it has a hole-formed portion where a nut insert hole is formed, at least one arm portion extending from the hole-formed portion, and said decorative plate holding surface formed on the arm portion, wherein the decorative plate holding surface is located at a position projected toward a side of the form panel compared to the hole-formed portion.

The decorative plate holding member may also be one that has a plurality of said arm portions extending radially from the hole-formed portion as a center.

A typical shape of the decorative plate holding member is characterized in that the four arm portions are arranged cross-shaped, and the hole-formed portion is positioned on the center of these arm portions. With this shaped decorative plate holding member, four decorative plates can be tentatively fixed at the same time.

Thus, the decorative plate tentative fixing mechanism of this invention has the decorative plate holding member for pressing the decorative plate against the form panel to tentatively fix it thereon, wherein the decorative plate pressing surface of the decorative plate holding member is elastically deformable in a direction along which it approaches and leaves from the form plate. Therefore, even when the decorative plates whose thickness is different are tentatively fixed by a single decorative plate holding member, the difference in thickness among the decorative plates can be adjusted by elastic deformation of the decorative plate holding member. Thus, the nut is fully screwed to thereby fix each decorative plate on the form plate reliably.

Next, in addition to the above feature, the decorative-plate tentative fixing mechanism is characterized in that the leg portion of the bolt projecting from the surface of the form panel is substantially covered by the nut.

The nut having the above feature can be constituted as follows. Namely, the nut has an annular portion, a grip portion formed on one end of the annular portion, and a circular plate portion formed on an outer circumferential surface of the annular portion, wherein the annular portion is closed at the side of the grip portion and has a size capable of being inserted into the nut insert hole of the decorative holding member, and the circular plate portion has a size engageable with the hole-formed portion.

In the decorative-plate tentative fixing mechanism of this invention as constituted above, the leg portion of the bolt which is removed after concrete is hardened is covered by the nut, whereby it is possible to avoid a defect that removal of the bolt becomes difficult due to attachment of hardened concrete to the bolt.

On the other hand, in addition to the above feature, the decorative-plate tentative fixing mechanism according to this invention is characterized in that a decorative-plate falling off prevention plate which is mechanically engageable with the decorative plate is mounted on an outer circumference of the nut at the side of the screw hole opening end, and is embedded in the concrete product with maintaining mechanical engagement condition with the decorative plate. With this constitution, since the decorative plate is held in place by means of the mechanical engagement of the decorative-plate falling off prevention plate, the decorative plate can surely be prevented from falling off the concrete surface.

Further, the decorative-plate tentative fixing mechanism of this invention is characterized to have a positioning means for defining an attachment position of each decorative plate on the surface of the form panel along a plane direction.

The positioning means may be constituted to have a plate-like member superposed on the surface of the form panel, which is formed with a fitting hole or a fitting groove for each decorative plate.

Instead, the positioning means may be constituted to have a joint form frame attached on the surface of the form panel, by which the attachment position of each decorative plate is divided by the joint form frame.

In this case, the joint form frame may have a head portion projecting from the surface of the form panel and a leg portion extending from the rear surface of the head portion, wherein the leg portion is held between two form panels arranged adjacent to each other and the head portion is projected from the surface of the form panels so that a joint groove is defined between the decorative plate on the concrete product.

With the positioning means provided, positioning of the decorative plate during its tentative fixing operation can easily be carried out. In particular, when the joint form frame is used, it positions the decorative plate and at the same time defines the joint width between the decorative plates. In comparison with the case where the positioning of the decorative plate and formation of the joint groove are carried out by using different members, operation can be simplified and the number of tools therefor can be reduced.

Where the joint form frame is used, it is preferable that the joint form frame is formed with the decorative-plate attachment hole.

In addition, as the decorative plate applicable to this invention, a stone material can be cited.

BEST MODE FOR CARRYING OUT THE INVENTION

Figure 1A:
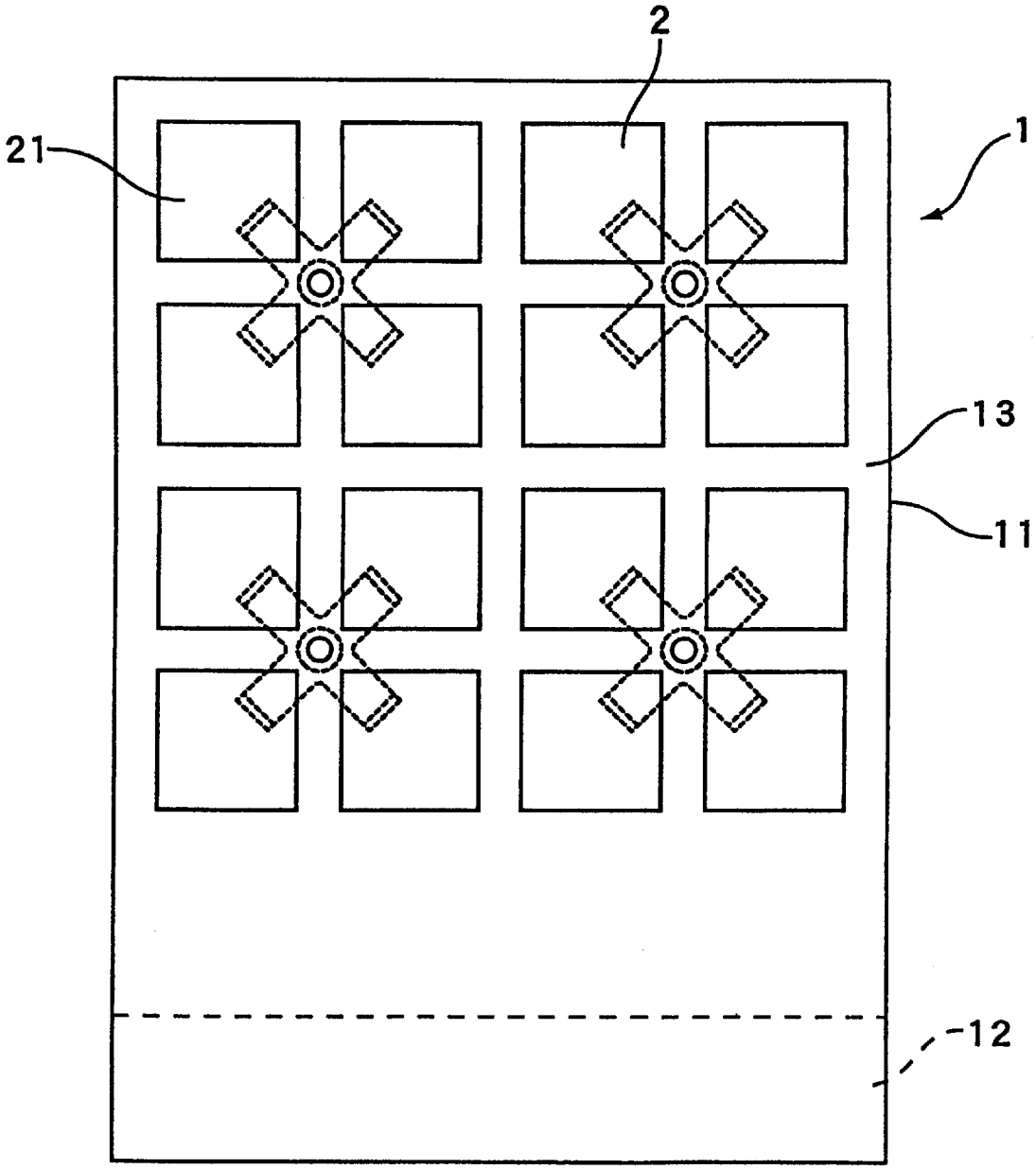
FIGS. 1(*a*) and 1(*b*) are a front view and a side view showing a concrete block for a retaining wall produced according to this invention, respectively.

Referring now to the drawings, there will be explained a method of placing decorative plates on a surface of a concrete bloc for a retaining wall, using a decorative-plate tentative fixing mechanism according to this invention.

Concrete Block for a Retaining Wall

Figure 1B:
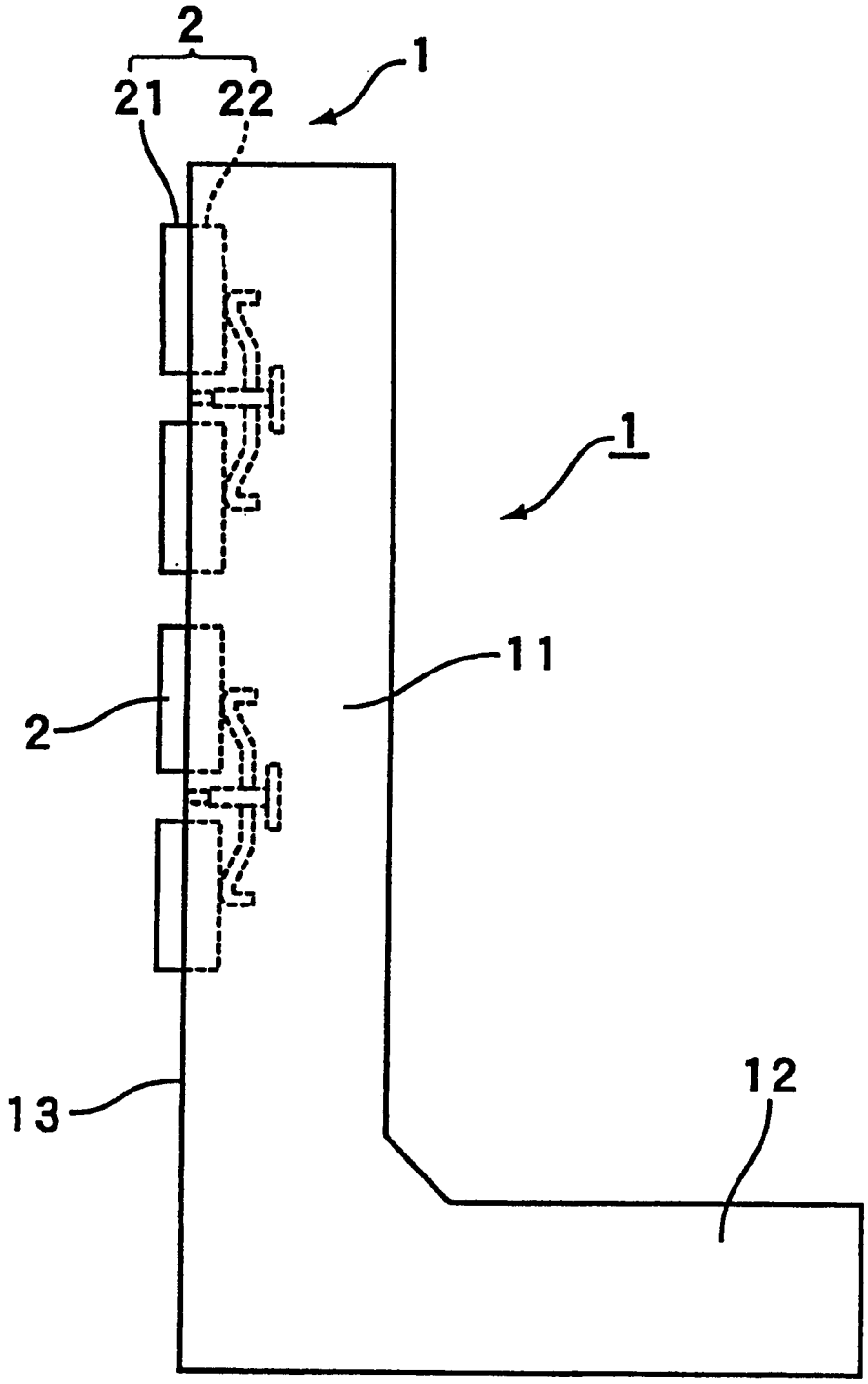

FIGS. 1(*a*) and 1(*b*) are a front view and a side view of a concrete block for a retaining wall whose surface is attached with stone materials. As shown in these figures, a concrete block 1 for a retaining wall is of an L-shaped section having a wall body portion 11 and a footing portion 12. On a surface 13 of the wall body portion 11, square stone materials 2 (decorative plates) having a constant thickness are attached in a grid-like state. The stone material 2 is embedded at its rear-surface side portion 22 in the surface 13 of the concrete wall body portion 11, and is projected at its front-side surface portion 21 from the surface 13 of the wall body portion.

Figure 2:
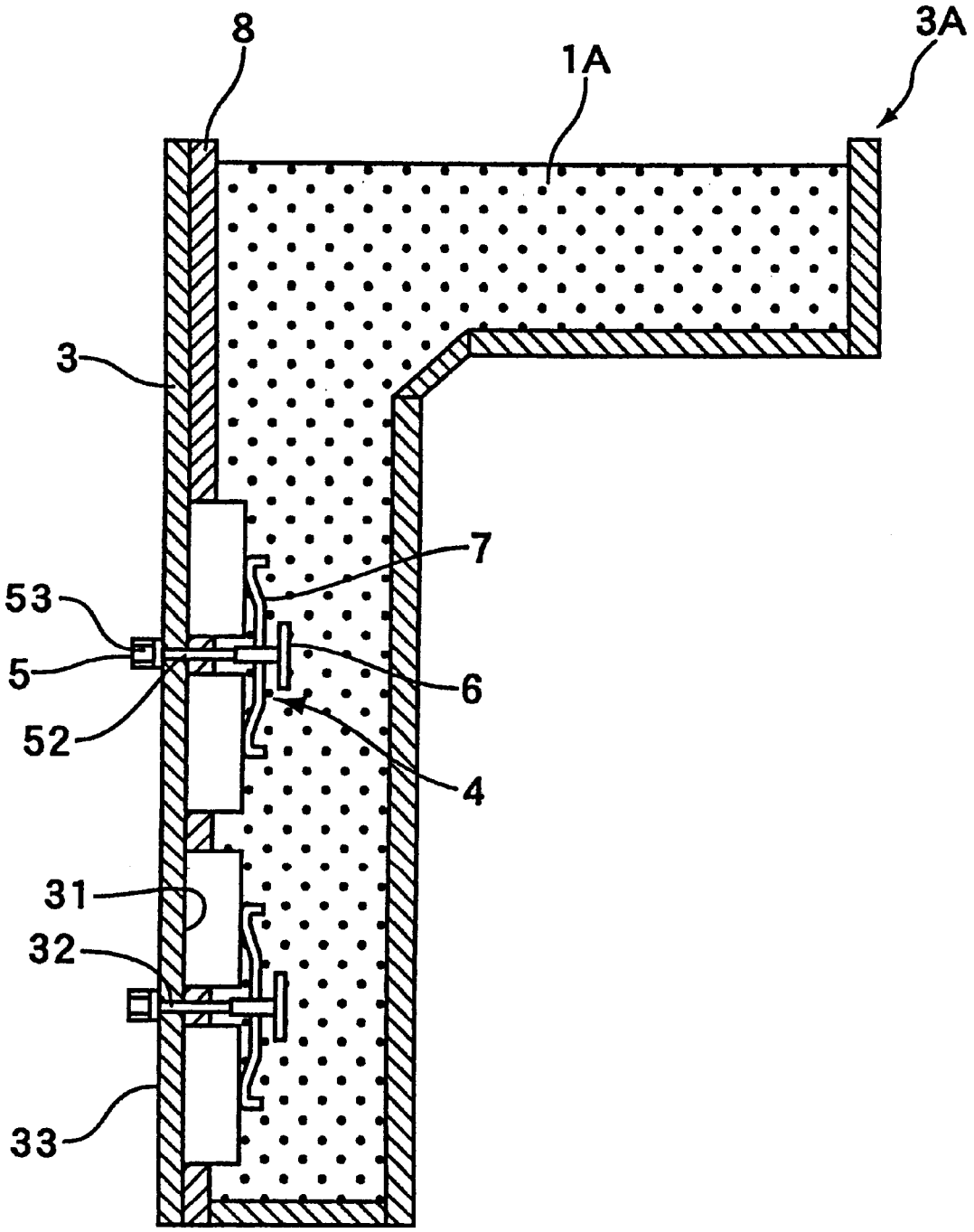
FIG. 2 is an explanatory view showing a condition that concrete is filled in a form of the concrete block of FIG. 1.

General Description of a Method of Producing the Concrete Block of the Retaining Wall FIG. 2 is a sectional view showing a state immediately after concrete is filled in a form of the concrete block for a retaining wall. With reference to this figure, a manufacturing process of the concrete block 1 for a retaining wall of this example will generally be explained.

First, form panels are used to constitute a form 3A for forming a concrete product. Then, the stone materials 2 are tentatively fixed on a surface of the form panel 7 which defines the surface 13 of the wall body portion of the concrete block 1 for a retaining wall. After that, concrete 1A is filled in the form 3A, tentative fixing of the stone materials 2 is removed after the concrete is hardened, and then the form panel 3 is removed. As a result, the concrete block 1 for a retaining wall is obtained which has the surface 13 of the wall body portion where the stone materials 2 are embedded as shown in FIG. 1.

Tentative Fixing Mechanism for Stone Materials

The tentative fixing mechanism for stone materials for use in the above manufacturing process is constituted as follows.

The tentative fixing mechanism for stone materials has a tentative fixing means 4 for pressing each stone material 2 on the surface 31 of the form panel 3 to tentatively fix it thereon, and an attachment hole 32 for the tentative fixing means formed in the form panel 3.

Figure 3:
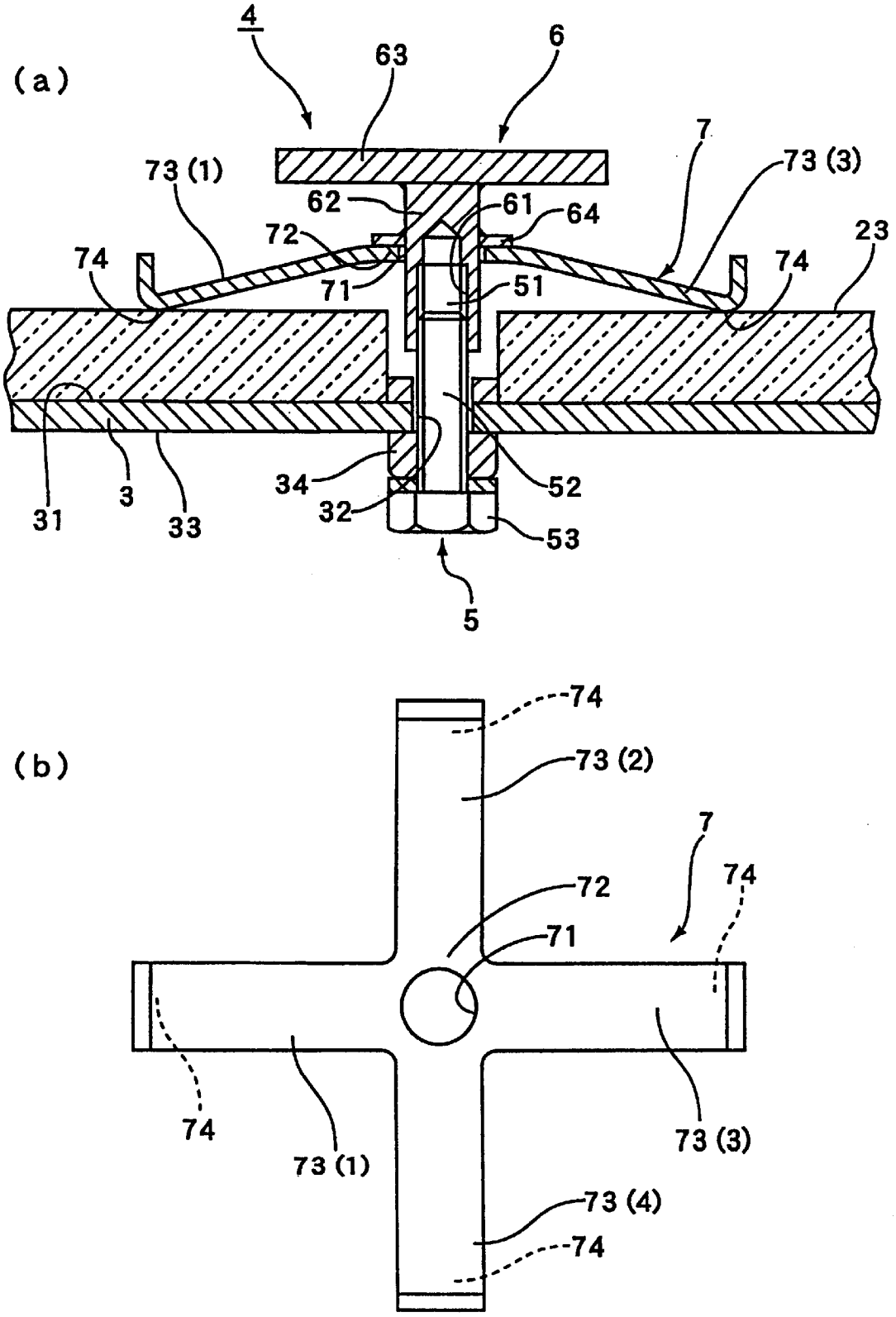
FIGS. 3(*a*) and 3(*b*) are a partial sectional view showing a condition in which an example of a tentative fixing means according to this invention is used to tentatively fix a stone material on a form panel, and a plane view showing a shape of a decorative-plate holding member.

FIG. 3 is a sectional view showing the tentative fixing means 4 in an enlarged state. Referring also to this figure, the tentative fixing means 4 has a bolt 5, a nut 6, and a decorative-plate holding member 7. The bolt 5 is, for example, a hexagon bolt and has a leg portion 52 formed with an external thread 51 and a head portion which has a hexagonal shape and is large than the leg portion 52. A reinforcement ring 34 is welded on a rear surface 33 of the form panel 3 where the tentative-fixing-means attachment hole 32 is formed.

The leg portion 52 of the bolt 5 is inserted into the tentative-fixing-means attachment hole 32 from the rear surface 33 of the form panel 3 and is projected at its end-side portion from the surface 31 of the form panel. The nut 6 is screwed on the projected portion of the bolt leg portion 52 to thereby press the stone materials 2 against the surface 31 of the form panel via the decorative-plate holding member 7.

On the other hand, the decorative-plate holding member 7 has a hole-formed portion 72 where a nut insert hole 71 is formed, four arm portions 73(1) to 73(4) spreading in a cross-like state from the hole-formed portion 72, and a decorative-plate holding surface 74 formed on each of the arm portions 73(1) to 73(4). The decorative-plate holding surface 74 is positioned projecting toward the side of the form panel compared to the hole-formed portion 72. Each of the arm portions 73(1) to 73(4) has a portion 75 from the hole-formed portion 72 to the decorative-plate holding surface 74 which is elastically deformable so that the decorative-plate holding surface 74 is movable in a direction approaching and leaving from the form panel.

In addition to the above constitution, the tentative fixing mechanism for the stone materials of this example is constituted so that the leg portion 52 of the bolt 5 projecting from the surface 31 of the form panel 3 is substantially covered by the nut 6.

More specifically, the nut 6 of this example has an annular portion 62 formed with a screw hole 61, a gripping cross bar fixed on one end of the annular portion 62, and a circular plate portion 64 formed on the outer circumference of the annular portion 62. The side of the annular portion 62 where the gripping cross bar 64 is fixed is closed to make the screw hole 61 a closed one.

The annular portion 62 is set to have a size of an outer diameter so as to be insertable into the nut insert hole 71 of the decorative-plate holding member 7. Whereas, the circular plate portion 64 has a size engageable with the hole-formed portion 72. Namely, the circular plate portion 64 has a shape one size larger than the nut insert hole 71. Therefore, when the nut 6 is screwed on the bolt 5, the decorative-plate holding member 7 is pressed toward the nut-screwing direction by the circular plate portion 64. As a result, the decorative-plate holding surface 74 in contact with the rear surface 23 of the stone material 2 presses the stone material 2 against the surface 31 of the form panel, whereby there is obtained a tentative fixing condition of the stone material on the surface 31.

Positioning Means for Stone Materials

Further, the tentative fixing mechanism for stone materials of this example has a positioning means for defining attachment positions of the respective stone materials 2 on the surface 31 of the concrete form panel along a plane direction.

Figure 4:
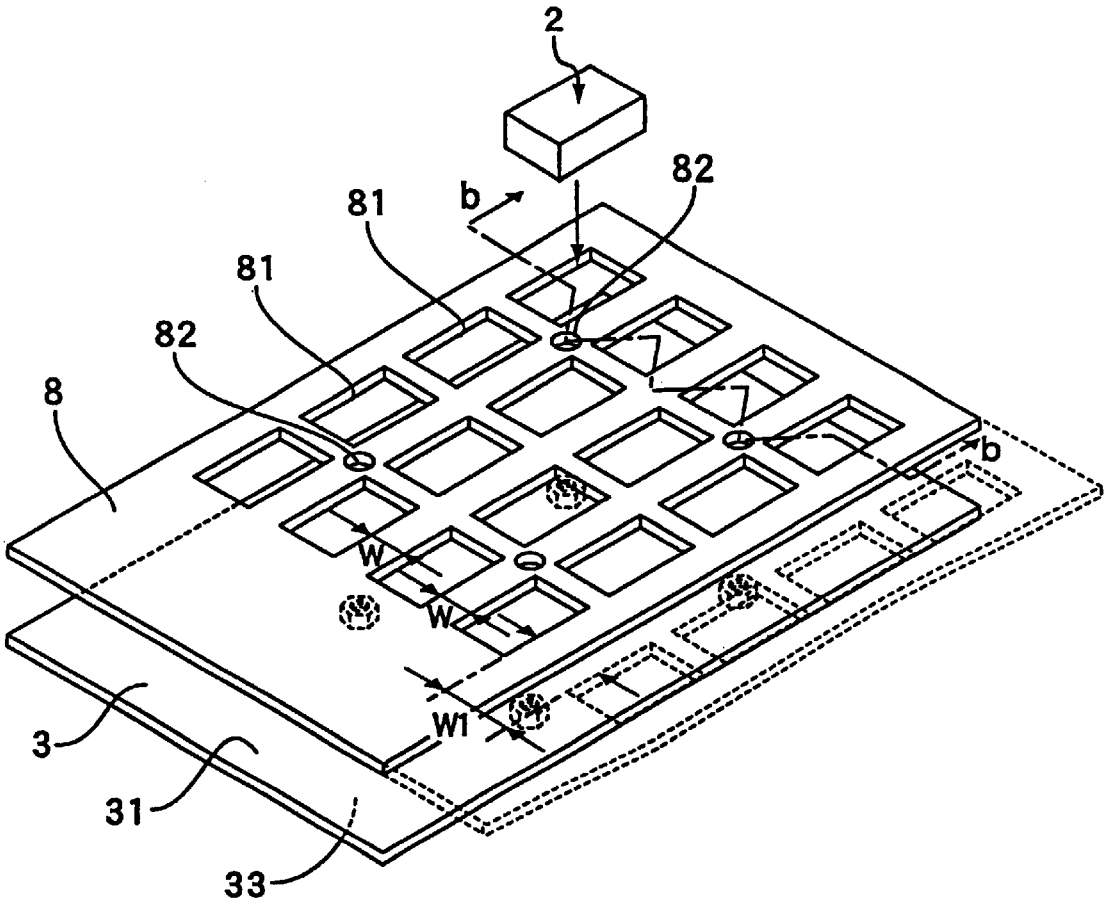
FIGS. 4(*a*) and 4(*b*) are explanatory views showing positioning procedure using a positioning form frame as an example of a positioning means of this invention.
Figure 4:
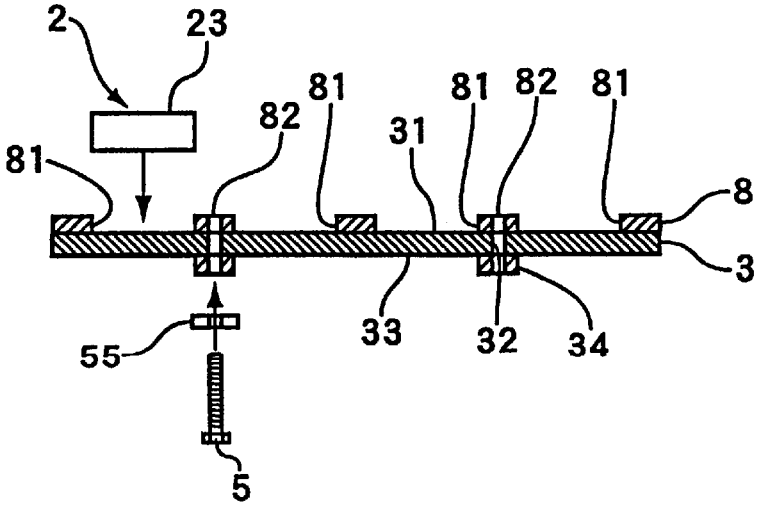

The positioning means is constituted by a positioning form frame 8 superposed on the surface 31 of the form panel 3. In FIG. 4, there is illustrated a condition of positioning of the stone materials by means of the positioning form frame 8. Referring to this figure, the positioning form frame 8 is formed with fixing holes 81 for the stone materials 2. Bolt insert holes 82 are also formed on places corresponding to the bolt insert holes 32 of the form panel 3. When the positioning form frame 8 is superposed on the surface 31 of the form panel 3, positioning grooves for receiving the stone materials 2 are defined by the fixing holes 81 of the positioning form frame 8 and the surface 31 of the form panel. Thus, the stone materials 2 can be positioned by fitting these stones into the respective grooves.

Tentative Fixing of Stone Materials with the Tentative Fixing Mechanism

Tentative fixing and removing operations of the stone materials with the tentative fixing mechanism as constituted above will be explained. First, as shown in FIG. 4, the form panel 3 for defining the wall surface 13 of the concrete block 1 for a retaining wall is placed horizontally facing upward, and then the positioning form frame 8 is superposed thereon. Then, the respective stone materials 2 are fitted in the respective stone-material attachment positions (fitting holes 81) defined by the positioning from frame 8. Thereafter, the tentative fixing means 4 is used to tentatively fix the respective stone materials on the form panel 3.

Figure 5:
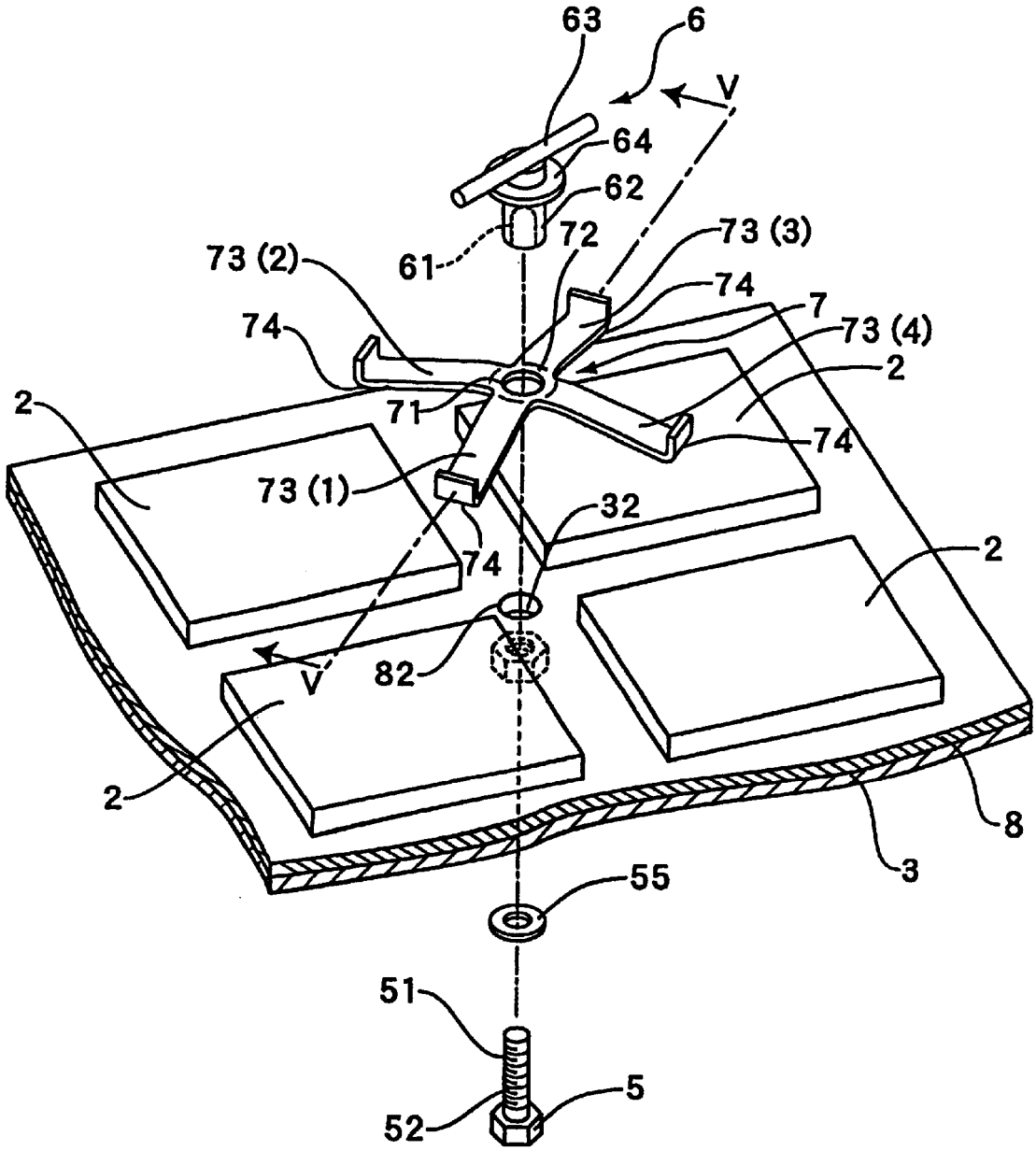
FIG. 5 is an explanatory view explaining procedures for tentatively fixing a stone material after positioning by using the tentative fixing means of FIG. 3.

FIG. 5 shows an operational condition in which four stone materials 2 are tentatively fixed. First, the bolt 5 of the tentative fixing means 4 is inserted into the bolt insert holes 32, 82 through a washer 55 from the side of the rear surface 33 of the form panel 3, to project the leg-end side portion of the bolt from the surface 31 of the form panel 3. Then, the nut 6 in the condition inserted into the nut insert hole 71 of the decorative-plate holding member 7 is screwed on the end of the bolt leg portion 52.

As a result, as shown in FIG. 3, the decorative-plate holding member 7 is pressed toward the form panel 3, namely toward the rear surface 23 of the stone material 2 by means of the circular plate portion 64 of the nut 6. As shown in FIG. 3, in this example, the four arm portions 73(1) to 73(4) of the decorative-plate holding member 7 are slanted to the side of its end toward the form panel 3, and is formed with the decorative-plate holding surface 74 of the end thereof. The decorative-plate holding surface 74 is bent toward opposite side at its tip edge portion. Thus, the respective stone materials 2 are pressed and fixed on the form-panel surface 31, whereby obtaining the tentative fixing condition.

Here, even when the four stone materials 2 have a different thickness, the respective decorative-plate holding surfaces 74 are elastically deformable along the nut-screw direction, whereby the respective stone materials can be tentatively fixed on the form panel 3 reliably.

Then, after the respective stone materials 2 are tentatively fixed on the form panel 3, the form panel 3 is lifted upright, and connected with other form panels to constitute the form 3A as shown in FIG. 2. Thereafter, concrete is poured in the form 3A from above. The removal operation of the tentative fixing means is carried out as follows after the concrete is hardened.

First, the bolt 5 of the tentative fixing means 4 exposing at the side of the rear surface 33 of the form panel 3 is loosened so that it is removed from the side of the nut 6 embedded in the concrete. Thereafter, the form panel 3 is removed, in other words, the form 3A is dismantled. As a result, the concrete block 1 for a retaining wall having a shape as shown in FIG. 1 can be obtained.

Modification of the Tentative Fixing Means

Figure 6:
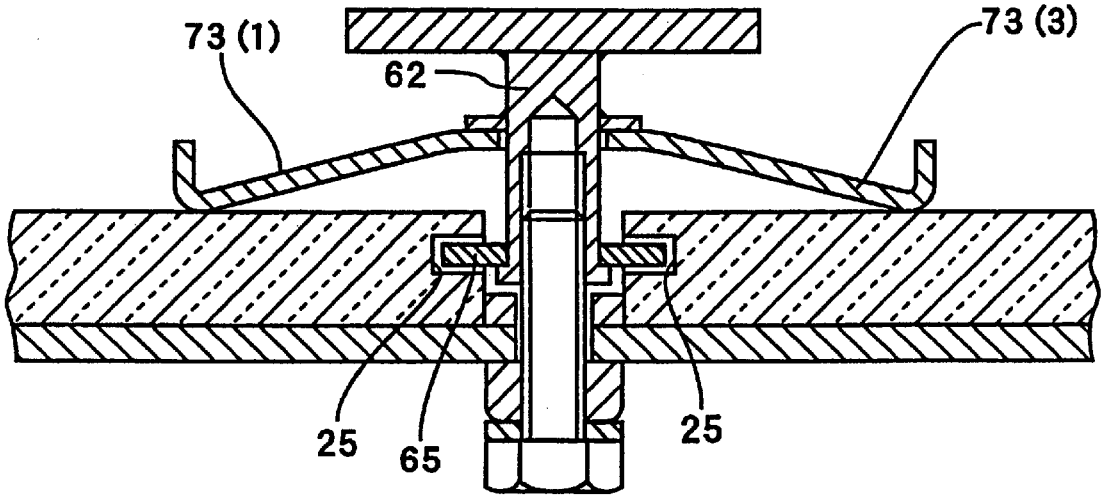
FIGS. 6(*a*) and 6(*b*) are a partial sectional view showing a tentative fixing means which is a modification of the tentative fixing means of FIG. 3, a partial plan view showing a decorative-plate holding member thereof, and a partial plan view showing a shape of an engagement plate for preventing falling off.
Figure 6:
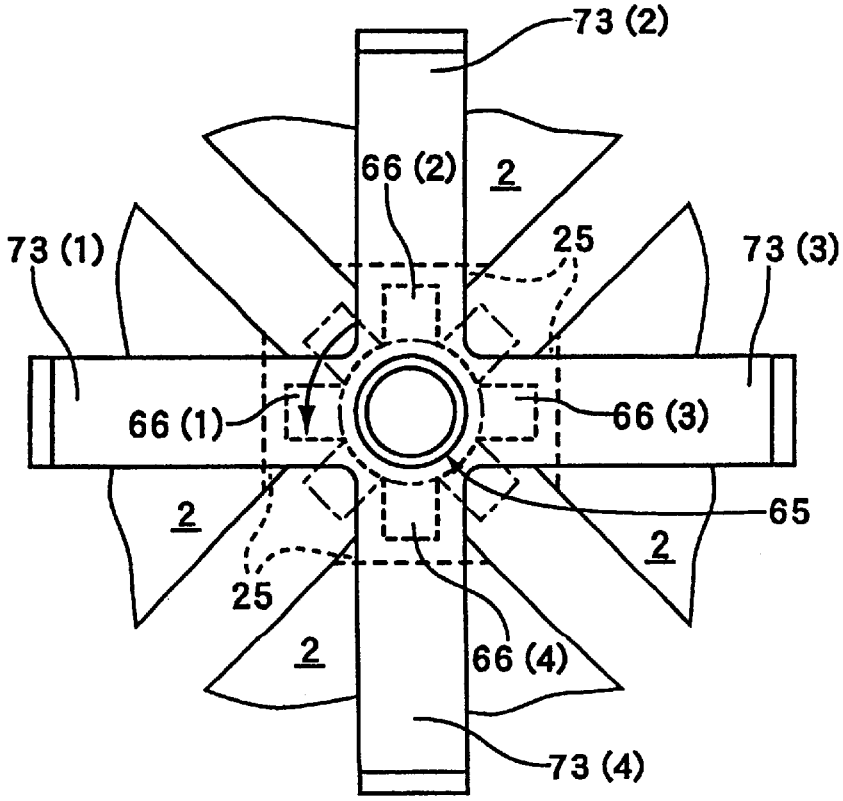

FIG. 6 shows a modification of the tentative fixing means 4. A tentative fixing means 40 shown in this figure has the same basic structure as that of the above-mentioned tentative fixing means 4, and a different point thereof is an engagement plate 65 for preventing decorative plates from falling off is provided on an outer circumference of a nut annular portion 62 at the side of a screw hole opening end. The engagement plate 65 has cross-like four engagement arms 66(1) to 66(4).

Whereas, the stone material 2 is formed at its side surfaces of four corners with engagement grooves into which the engagement arms 66(1) to 66(4) are insertable laterally by rotating the engagement arms of the engagement plate 65.

The engagement arms 66(1) to 66(4) are set to have a size insertable between the stone materials 2, that is, the joint portions. Thus, in FIG. 6(*b*), the engagement arms 66(1) to 66(4) of the engagement plate 6 attached to the nut 6 are inserted into the joint portions between the stone materials 2 in a position shown by imaginary lines. Next, the engagement plate 65 is rotated in a direction as shown by an arrow. As a result, the respective engagement arms are fitted in the grooves 25 of the stone materials 2, which function as members for preventing the stone materials from falling off. In other words, the stone material 2 is held and tentatively fixed between the decorative holding member 7 of the tentative fixing means 4 and the form panel 3, and at the same time is held between the decorative holding member 7 and the engagement plate 65.

Therefore, even after the bolt 5 is removed after concrete is hardened, the stone material is maintained in a condition held between the decorative holding member 7 attached to the nut 6 and the engagement plate 65. Hence, the stone material 2 is prevented from falling off the concrete surface 13 by bonding of concrete and the mechanical engagement of the engagement plate 65.

Another Examples of the Form Panel and the Positioning Means

Figure 7:
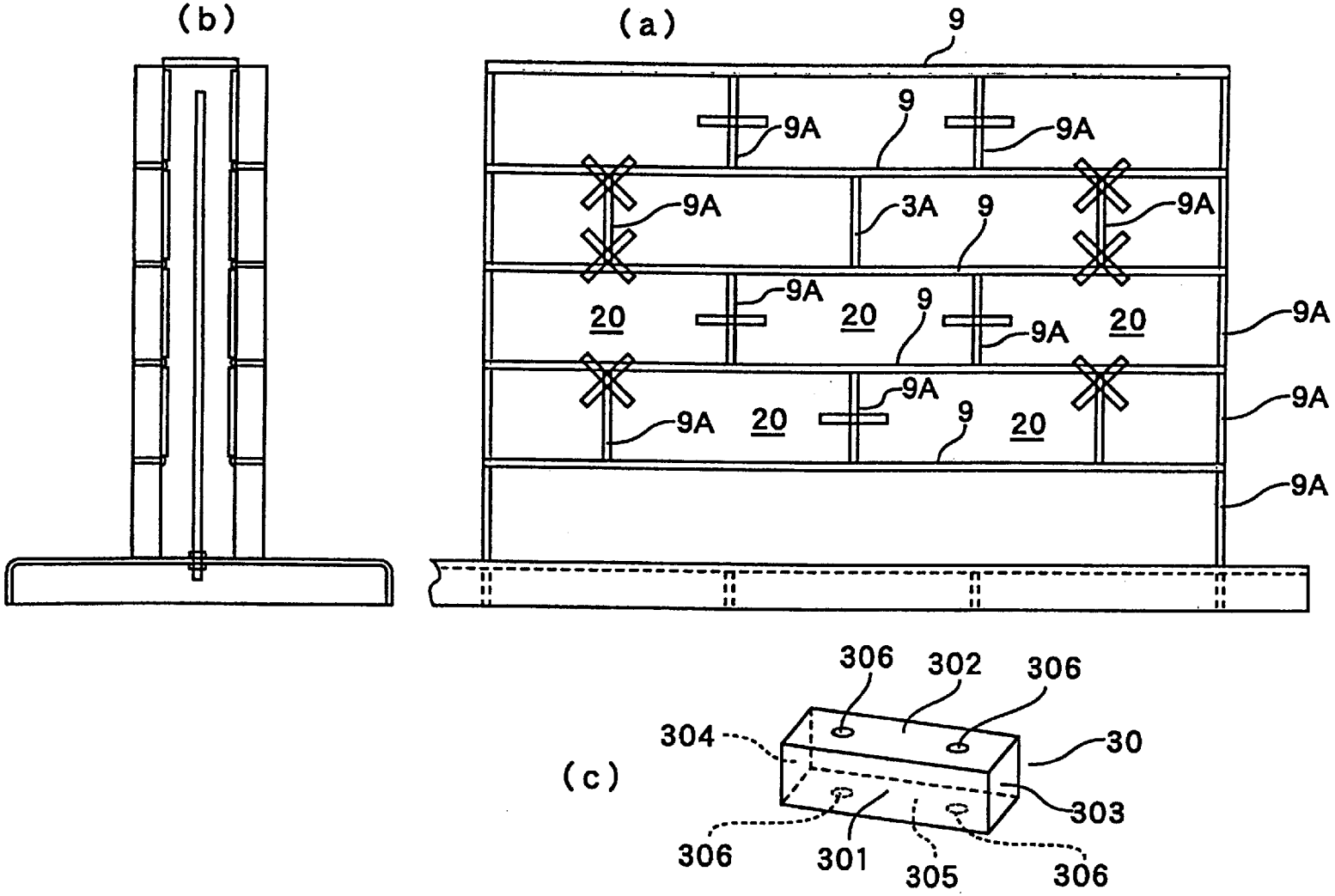
FIGS. 7(*a*), 7(*b*) and 7(*c*) are a front view of a form constituted by a different form panel, a sectional view thereof, and a perspective view of the form frame.
Figure 8:
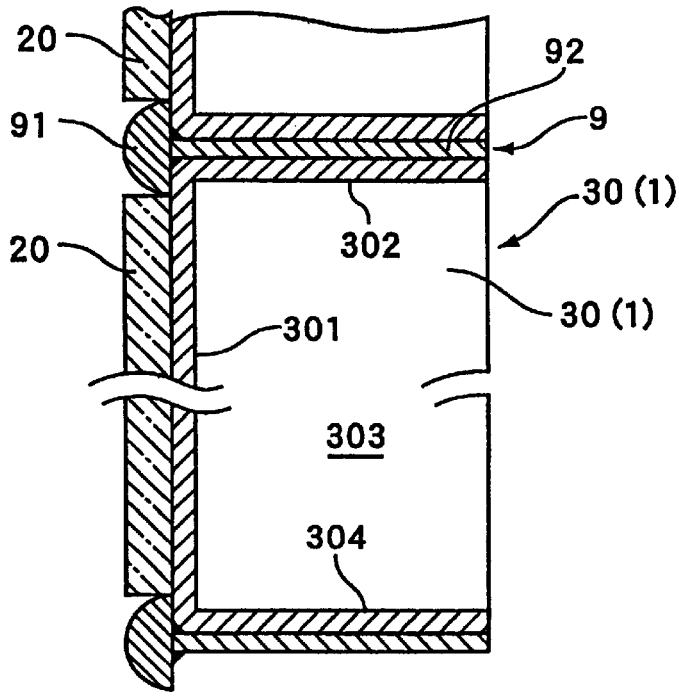
FIGS. 8(*a*), 8(*b*) and 8(*c*) are a partial sectional view of the form of FIG. 7, a partial perspective view of the joint form frame of FIG. 7, and a partial perspective view of a joint form frame having a different shape.
Figure 8:
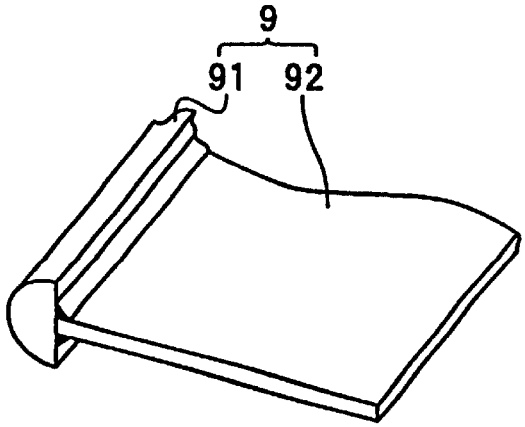
Figure 8:
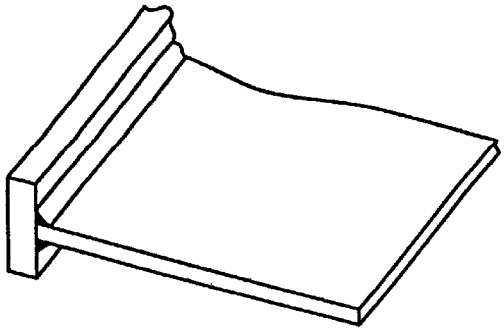

FIGS. 7 and 8 show another examples of the above-mentioned form panel 3 and the positioning means. A form block 30 shown in these figures is shaped to have a surface panel portion 301 which has a shape similar to and one size larger than the stone material 20 tentatively fixed thereon, and side panel portions 302 to 305 which have a constant width and bent perpendicular from four edges of the surface panel portion. Further, the upper and lower side surfaces 302 and 305 are formed with bolt holes 306 through which the form blocks 30 are connected with each other by bolts. The form blocks 30 are piled longitudinally and laterally in a condition that longitudinal joint form frames 9 A and lateral joint form frames 9 are held between them, and are connected with each other to constitute a form 30A.

More specifically, the lateral joint form frame 9 is held between the upper side surface 302 of the form block 30(1) and the lower side surface 305 of the form block 30(2) (not shown) piled on the form block 30(1). The lateral joint frame 9 is constituted to have a head portion 91 projecting from the surface 301 of the form block 30 and a leg portion 92 extending from the rear surface of the head portion 91. The head portion 91 is shaped to have a semi-circular section, and the leg portion 92 is a plate-like member having a constant thickness. The thus constituted joint form frame 9 has a length, for example, encompassing the whole width of the form block 30 constituting the stone-material attachment surface of the form 30A.

Similarly, the longitudinal joint form frame 9A having the similar shape is held between the side panel portion 303 at the side of the form block 30(1) and the side panel portion 305 at the side of the from block (not shown) positioned adjacent thereto.

Thus, on the stone-material attachment surface of the form 30A of this example, respective portions enclosed by the respective joint form frames 9, 9A are attachment positions of the respective stone materials 20. Namely, the attachment position of the stone material is defined by the head portions 91 of the joint form frames. According to this example, the respective joint form frames constitute the positioning means.

The form 30A as constituted above is poured with concrete and, after the concrete is hardened, is dismantled, whereby the stone-material attachment surface of the obtained concrete block for a retaining wall is formed with joint grooves of a semicircular section opening outwardly. The joint grooves are filled with a joint material to form joints between the stone materials.

When the joint form frames are used as in this example, an advantage can be obtained that the respective joints are made to have a constant width, compared to the case where the positioning form frame as shown in FIG. 4 is used. More specifically, when the positioning form frame shown in FIG. 4 is used, a connecting portion between these frames becomes to have a width w1 larger than that w of the other portions. Thus, it is required any means for adjusting the joint width w1 to be the same as the joint width w of the other portions. With the joint form frames 9, 9A as in this example, the joint width of each part can be made constant.

As the joint form frame, one can be used that has a head portion of a rectangular sectional shape as shown in FIG. 8(*c*).

Other Examples

Although the stone material is used as the decorative plate in the above examples, it is of course to use any materials other than the stone material.

Further, the concrete form product may be those other than that for a retaining wall as in the above examples. Furthermore, this invention can also be applied to the case where the decorative plates are attached on the surface of a cast-in-place concrete wall, as well as the case where the decorative plates are attached on the surface of a concrete product manufactured in a factory.

Moreover, although the decorative-plate holding member 7 of the above tentative fixing means 4 is formed with the four arm portions of a cross-like shape, it may be formed with three or two arm portions, instead. In these cases, three and two decorative plates can be tentatively fixed at one time, respectively. Of course, a single arm portion may be formed to tentatively fix only one derorative plate.

INDUSTRIAL APPLICABILITY

As explained above, in the decorative-plate tentative fixing mechanism according to this invention, the tentative fixing means for tentatively fixing the decorative plate on the surface of the form panel is formed with the elastically deformable arm portions. Therefore, even if the decorative plates which are to be tentatively fixed at one time have a different thickness, the respective arm portions are elastically deformed to press and fix the respective decorative plates on the form panel reliably.

Further, the leg portion of the bolt which is to be removed after concrete is hardened is substantially covered by the nut and is prevented from adhesion of concrete. Thus, the bolt can easily be removed.

Furthermore, the nut of the tentative fixing means which is left embedded in concrete is provided with the falling off prevention member engaging mechanically with the decorative plate. Therefore, the decorative plate is held not to fall off the concrete surface by means of the mechanical engagement of the falling off prevention member embedded in the concrete, as well as by bonding of concrete. Whereby, the decorative plate can surely attached on the concrete surface.

In addition, in this invention, the joint form frame is used to constitute the positioning means for defining the attachment positions of the decorative plates. Hence, the same member is used to realize both of the positioning mechanism for defining the attachment positions of the decorative plates and the forming mechanism for forming the joint portions between the attached decorative plates. The joint portions can also be made a constant width.

What is claimed is:

1. A tentative fixing mechanism used for tentatively fixing a decorative plate beforehand on a form panel in order to obtain a concrete product having the decorative plates attached on a surface thereof, the tentative fixing mechanism comprising:

a tentative fixing element for pressing the decorative plates against a surface of the form panel to fix thereon tentatively, and an attachment hole for the tentative fixing element formed in the form panel, the tentative fixing element has a bolt, a nut, and a decorative-plate holding member, wherein the bolt has a head portion and a leg portion formed with an external thread, the leg portion of the bolt is inserted into the attachment hole for the tentative fixing element from a rear surface of the form panel, the nut is screwed on a projected portion of the leg portion from the form panel to press the decorative plate against the surface of the form panel via the decorative-plate holding member, the decorative-plate holding member has a hole-formed portion where a nut insert hole is formed, at least four arm portions formed so that they spread radially and separately from the hole-formed portion as a center, and a decorative-plate holding surface formed on each of the arm portions, said decorative-plate holding surface being elastically deformable in a nut-screwing direction, and after concrete is hardened, only the bolt is removed, and the nut and the decorative-plate holding member are left embedded in the concrete product.

2. The mechanism for tentatively fixing a decorative plate according to claim 1, wherein the four arm portions are formed so that they are arranged to be a cross-like shape.

3. The mechanism for tentatively fixing a decorative plate according to claim 1, wherein the leg portion of the bolt projecting from the surface of the form panel is substantially covered by the nut.

4. The mechanism for tentatively fixing a decorative plate according to claim 3, wherein the nut has an annular portion where a screw hole is formed, a grip portion formed on one end of the annular portion, and a circular plate portion formed on an outer circumference of the annular portion, and wherein the annular portion is closed at the side of the grip portion and has a size insertable into the nut insert hole of the decorative-plate holding member, and the circular plate portion has a size engageable with the hole-formed portion.

5. The mechanism for tentatively fixing a decorative plate according to claim 1, wherein a decorative-plate falling off prevention plate is attached on an outer circumference of the nut adjacent a screw hole open end, and is to be left embedded in the concrete product.

6. The mechanism for tentatively fixing a decorative plate according to claim 1, further comprising a positioning means for defining attachment positions of the decorative plates on the surface of the form panel in a plane direction.

7. The mechanism for tentatively fixing a decorative plate according to claim 6, wherein the positioning means has a plate-like portion superposed on the surface of the form panel, and the plate-like portion is formed with fixing holes or grooves for the respective decorative plates.

8. The mechanism for tentatively fixing a decorative plate according to claim 1, wherein the decorative plate is a stone material.

* * * * *

UNITED STATES PATENT AND TRADEMARK OFFICE

CERTIFICATE OF CORRECTION

PATENT NO. : 6,257,545 B1
DATED : July 10, 2001
INVENTOR(S) : Tokita et al.

It is certified that error appears in the above-identified patent and that said Letters Patent is hereby corrected as shown below:

Title page,
Item [54], after "DECORATIVE", please delete "SHEET" and insert -- PLATE --.
Item [75], please delete "Fumiski" and insert -- Fumiaki --.

Signed and Sealed this

Thirty-first Day of December, 2002

JAMES E. ROGAN
*Director of the United States Patent and Trademark Office*